United States Patent [19]

Seto et al.

[11] Patent Number: 4,737,684

[45] Date of Patent: Apr. 12, 1988

[54] THIN FILM EL ELEMENT HAVING A CRYSTAL-ORIENTABLE ZNO SUBLAYER FOR A LIGHT-EMITTING LAYER

[75] Inventors: Hiroyuki Seto; Katsuhiko Tanaka, both of Nagaokakyo, Japan

[73] Assignee: Murata Manufacturing Co., Ltd., Japan

[21] Appl. No.: 828,020

[22] Filed: Feb. 10, 1986

[30] Foreign Application Priority Data

Feb. 21, 1985 [JP] Japan ..... 60-33925
Feb. 27, 1985 [JP] Japan ..... 60-38391

[51] Int. Cl.[4] ..... H05B 33/14; H05B 33/26

[52] U.S. Cl. ..... 313/503; 313/506; 313/509; 357/10

[58] Field of Search ..... 313/499, 503, 506, 509; 357/10, 63

[56] References Cited

U.S. PATENT DOCUMENTS 3,420,763 1/1969 Polito et al. ..... 357/10 X
4,140,937 2/1979 Vecht et al. ..... 313/509 X

*Primary Examiner*—David K. Moore
*Assistant Examiner*—Sandra L. O'Shea
*Attorney, Agent, or Firm*—Ostrolenk, Faber, Gerb & Soffen

[57] ABSTRACT

A thin film EL element comprises a substrate, an electrode formed on the substrate, a ZnO insulation layer which is formed on the electrode and which has crystalline orientability, a light emitting layer formed on the ZnO insulation layer having crystallinity, and a second electrode formed on the light emitting layer. The ZnO insulation layer having crystalline orientability, is formed as a sublayer for the light emitting layer, and is made of a material having its c-axis oriented perpendicular to the substrate.

20 Claims, 8 Drawing Sheets

THIN FILM EL ELEMENT HAVING A CRYSTAL-ORIENTABLE ZNO SUBLAYER FOR A LIGHT-EMITTING LAYER

BACKGROUND OF THE INVENTION

1. Field of the Invention

This invention relates to improvements in an electroluminescence (EL) element which emits light when an AC or DC voltage is applied thereto, and more particularly it relates to improvements in a thin film EL element having a light emitting layer formed by thin film formation method such as electron beam deposition or sputtering.

2. Description of the Prior Art

FIG. 2 is a sectional view of a prior art thin film EL element adapted to be driven by AC. This thin film EL element 1 has a light-premeable substrate 2 made of transparent glass, and a transparent electrode 3 made, e.g., of $In_2O_3$—$SnO_2$. Formed on this transparent electrode 3 is an insulation layer 4, on which is formed a light emitting layer 5 made, e.g., of ZnS:$TbF_3$, the light emitting layer 5 being sandwiched between an insulation layer 6 formed on the upper surface thereof and the insulation layer 4. The first insulation layer 4, the light emitting layer 5 and the second insulation layer 6 are formed by sputtering. The first and second layers 4 and 6 are formed of a non-crystalline or polycrystalline dielectric film of $Y_2O_3$, $Si_3N_4$, $Al_2O_3$ or the like. As the other electrode, an electrode 7 is formed in a lattice pattern on the second insulation layer 6 so as oppose to the transparent electrode layer 3.

Since EL elements function as display devices, first, high brightness and high efficiency are required and, second, it is preferable that they can be driven with low voltage. The efficiency and drive voltage of such thin film EL elements depend largely on the crystallinity of ZnS which forms the light emitting layer, and it is desirable that the crystallinity of the light emitting layer be superior. In the conventional thin film EL element 1 shown in FIG. 2, the light emitting layer 5 is formed by sputtering on the surface of the first insulation layer 4 made of $Y_2O_3$, $Si_3N_4$ or $Al_2O_3$. However, normally where an insulation layer is formed of a dielectric film of $Y_2O_3$, $Si_3N_4$ or $Al_2O_3$, and where the light emitting layer 5 is formed thereon, its crystallinity in early periods of growth is poor, resulting in the portion A of the light emitting layer 5 becoming a so-called dead layer, as shown in FIG. 2, which presents an obstacle to increasing brightness and efficiency and to reduction of drive voltage.

On the other hand, in a DC type thin film EL element driven with DC, not shown, there is no need of insulating the light emitting layer from the electrodes; thus, its arrangement is the same as that of the AC-driven thin film EL element 1 shown in FIG. 2 excluding the first and second insulation layers 4 and 6. In this DC-driven thin film EL element, like the AC-driven thin film EL element, it is necessary to form a light emitting layer having satisfactory crystallinity. As an example thereof, it has been reported that a thin film EL element of high efficiency can be obtained by forming a vapor-deposited film of ZnSe as a buffer layer on a transparent electrode and then forming thereon a light emitting layer of ZnS:$TbF_3$. FIG. 3 is a graph showing the relation between the thickness and light emitting efficiency of a light emitting layer of ZnS-$TbF_3$, the dot-and-dash line indicating an example of a thin film EL element having a transparent electrode of $In_2O_3$—$SnO_2$, a ZnSe vapor-deposited film, a ZnS:$TbF_3$ light emitting layer and an Al electrode, which are successively formed in the order mentioned. The dotted line indicates a comparative example prepared by removing the ZnSe vapor-deposited film from the thin film EL element shown by the solid line. As is clear from FIG. 3, the element with the buffer layer of ZnSe attains satisfactory light emitting efficiency from the very thin region where the thickness of the Zns:$TbF_3$ which is the light emitting layer is about 0.2 $\mu$m. This indicates that the ZnSe vapor-deposited film has satisfactory crystalline structure and forms a substrate for the light emitting layer, enabling the formation of a thin film EL element of high efficiency to be attained. Thus, the ZnSe vapor-deposited film may be taken as being capable of improving the crystallinity in early periods of growth of the light emitting layer of ZnS. Therefore, such concept would be applicable also to the AC-driven thin film EL element.

However, in an electrical circuit, the ZnSe vapor-deposited film serving as a buffer layer would be connected in series with the light emitting layer of ZnS, and application of voltage would result in a voltage drop due to the ZnSe vapor-deposited film. This voltage drop must be minimized in order to reduce the required drive voltage. From the standpoint of reduction of drive voltage, it goes without saying that it is better not to form any ZnSe vapor-deposited film, even if such resistive ZnSe vapor-deposited film caused a minimal of voltage drop. The same may be said not only of the DC-driven thin film EL element but also of the AC-driven thin film EL element.

SUMMARY OF THE INVENTION

Accordingly, an object of the invention is to provide a thin film EL element whose light emitting layer has improved crystallinity and which, therefore, is highly efficient and can be driven with low voltage.

According to a broad aspect of the invention, there is provided a thin film EL element at least including a substrate, a transparent electrode, and a light emitting layer, the thin film EL element being characterized in that as a sublayer for the light emitting layer, there is formed a crystal-orientable ZnO layer with its c-axis oriented perpendicular to the substrate. Particularly, the crystal-orientable ZnO layer has a high degree of crystal-orientability along its c-axis, i.e. in the direction of its own thickness. Thus, a light emitting layer, having improved crystallinity along the c-axis of the ZnO layer, is formed on this ZnO layer. This ZnO layer is made of ZnO containing a slight amount of Li, Al or the like.

In addition, the invention is applicable to both AC-driven and DC-driven thin film EL elements; for the AC-driven type, the ZnO layer having a high crystal-orientability should be made insulative, and for the DC-driven type, the corresponding ZnO layer should be made electrically conductive.

These objects and other objects, features, aspects and advantages of the present invention will become more apparent from the following detailed description of preferred embodiments of the present invention when taken in conjunction with the accompanying drawings.

DESCRIPTION OF THE PREFERRED EMBODIMENTS

Figure 1:
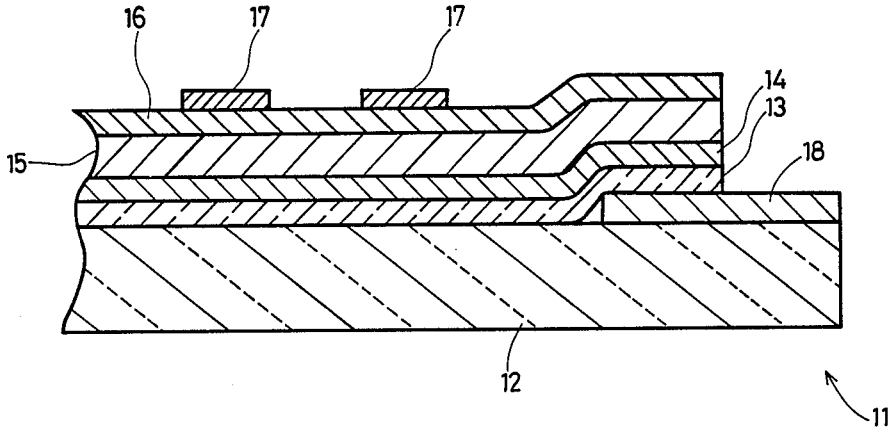
FIG. 1 is a fragmentary sectional view showing a thin film EL element according to a first embodiment of the invention.

FIG. 1 is a fragmentary sectional view showing an embodiment of the invention. The thin film EL element 11 of this embodiment is an AC-driven type thin film EL element. In this case, a lead electrode 18 of Al is formed by vapor-deposition on a light-permeable substrate 12 made, e.g., of Corning's 7059 glass. A transparent electrode 13 is formed on the light-permeable substrate 12 so that it can be electrically connected to the lead electrode 18. The transparent electrode 13 is a crystal-orientable ZnO electrode with its c-axis oriented perpendicular to the substrate 12, the ZnO being doped with Al, as will be later described. A crystal-orientable ZnO insulation layer 14, with its c-axis oriented perpendicular to the substrate 12, hereinafter referred to as a first insulation layer, is formed on the upper surface of the ZnO transparent electrode 13 by RF magnetron sputtering. Formed on the upper surface of the ZnO insulation layer 14 by sputtering is $ZnO:TbF_3$ light emitting layer 15, on the upper surface of which are formed a second insulation layer 16 and back electrodes 17.

Figure 2:
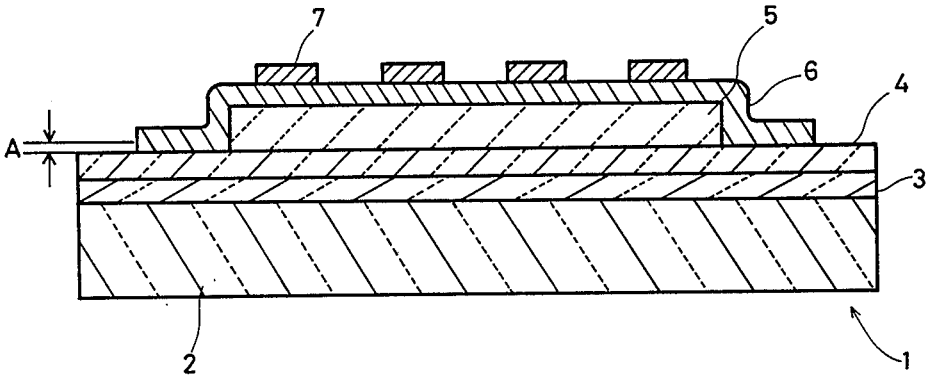
FIG.2 PRIOR ART
FIG. 2 is a schematic sectional view showing a conventional thin film EL element.
Figure 3:
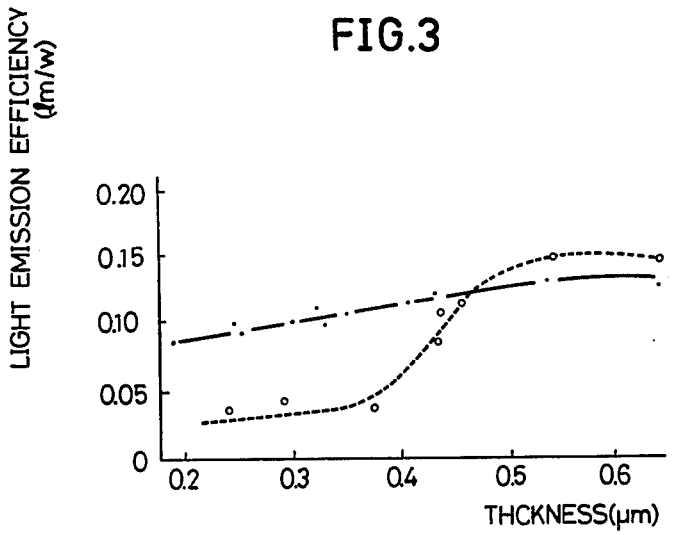
FIG. 3 is a graph showing the relation between the thickness and light emission efficiency of a light emitting layer made of $ZnS:TbF_3$.

The lamination structure of the layers described above is substantially the same as in the conventional thin film EL element shown in FIG. 2. However, in the thin film EL element of this embodiment, since the transparent electrode 13 and the first insulation layer 14 are superior in c-axis orientation, a ZnO film of improved crystalline orientability will be grown, which will result in formation of a light emitting layer 15 having high crystallinity. In this connection, it is to be noted that to obtain such ZnO layer of improved crystalline orientation, it was previously believed that a film thickness of more than about 1 μm would ordinarily be required. Therefore, the use of an unmodified ZnO film as an insulation element for a thin film EL element as discussed above would be unsuitable as it would lead to an increase in the required drive voltage.

Figure 4:
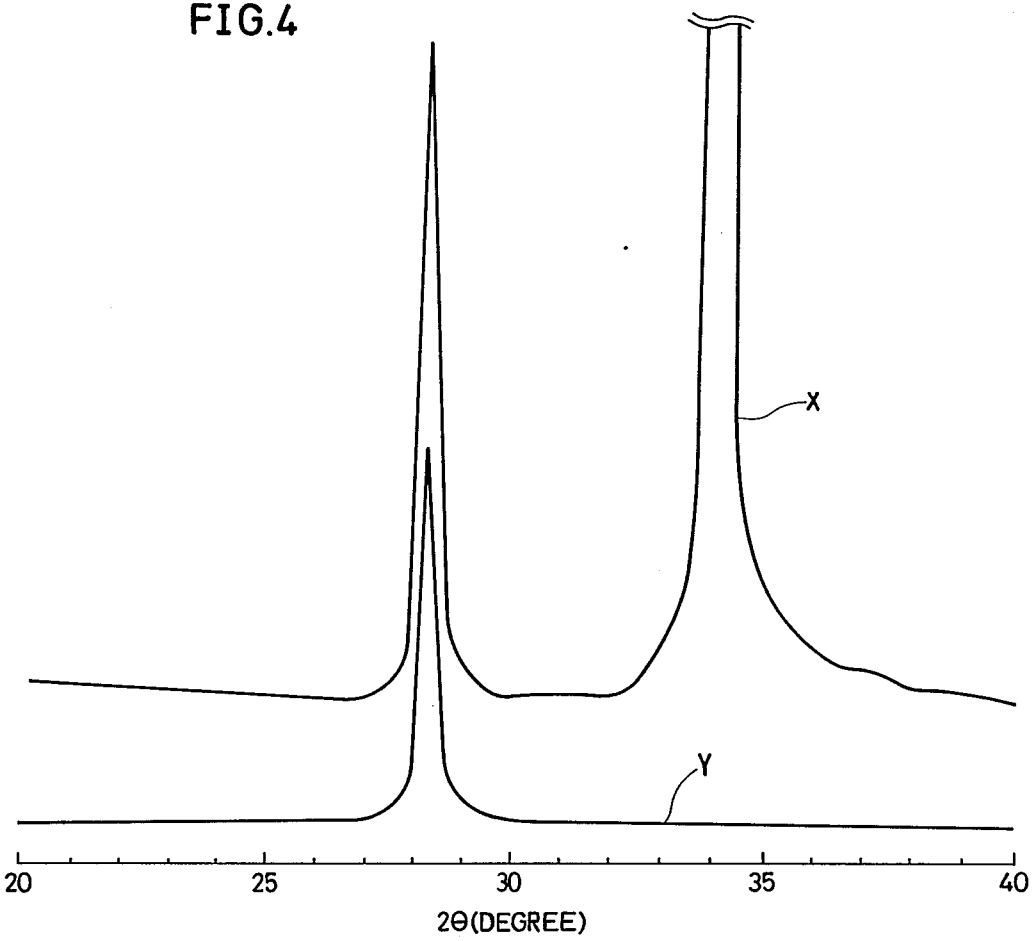
FIG. 4 is a graph showing X-ray diffraction patterns of the thin film EL element of the embodiment shown in FIG. 1 and of the prior art, respectively.
Figure 5:
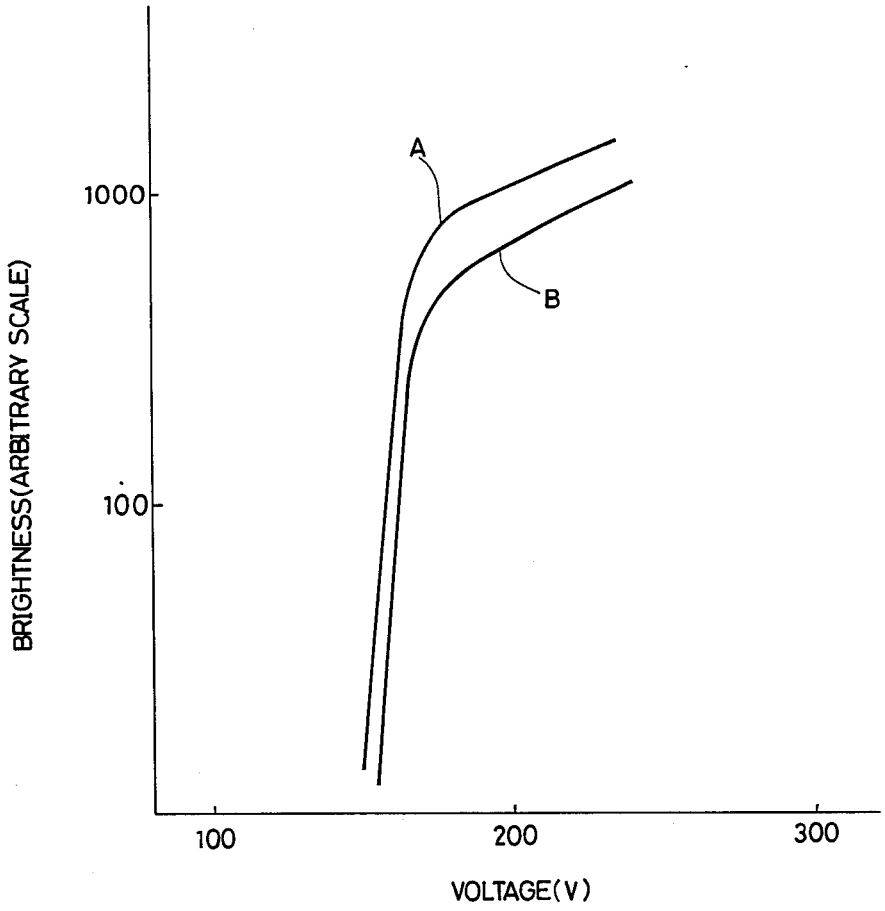
FIG. 5 is a graph showing the brightness versus voltage characteristics of the FIG. 1 embodiment and of the prior art example.

However, in this embodiment, an insulation layer 14 of ZnO doped with Li is formed on a crystal-orientable transparent electrode 13 of ZnO doped with Al; thus, if the crystal-orientable ZnO electrode 13 is thick to a certain extent, a c-axis oriented film of satisfactory crystallinity can be formed despite the fact that the insulation layer 14 is thin. Therefore, even with the first insulation layer 14 maintained thin, even if less than 1 micron, it is possible to form a light emitting layer 15 of superior crystallinity. FIG. 4 shows x-ray diffraction patterns of (X) of this embodiment in which a light emitting layer is formed on the insulation layer 14 in the form of a c-axis crystal-orientable ZnO film and an example in which a light emitting layer is formed on an insulation layer in the form of a conventional $Al_2O_3$ film. The solid line X indicates the embodiment and the solid line Y and the conventional example. The light emitting layers in both cases were formed of $ZnS:TbF_3$ film. In this embodiment, the thickness of the ZnO transparent electrode 13 of this embodiment is about 8000 Å and that of the ZnO insulation layer 14 is about 2000 Å. The brightness-voltage characteristic of this embodiment is indicated by the solid line A in FIG. 5. In addition, for comparison purposes, the brightness-voltage characteristic of the conventional thin film EL element is indicated by the solid line B. From FIGS. 4 and 5, it is seen that in this embodiment, the crystallinity of the ZnS light emitting layer is improved, so that low voltage drive and high brightness can be attained and hence a highly efficient, thin film EL element can be produced.

While the above embodiment refers to an AC-driven type thin film EL element 11, it is to be emphasized that the invention is also applicable to a DC-driven thin film EL element. That is, the use of crystal-orientable ZnO electrode as a transparent electrode makes it possible to likewise improve the crystallinity of the light emitting layer formed thereon even in the case of a DC-driven type thin film EL element in which no first insulation layer is formed.

As for the light emitting layer, in the above embodiment $ZnS:TbF_3$ was used, but other types of light emitting layers may also be used that include any other desired types of ZnS, such as ZnS:Mn, $ZnS:PrF_3$, $ZnS:DyF_3$, $ZnS:TmF_3$, ZnS:Cu and the like, and it is also possible to use other types of light emitting layers made mainly of SrS, CaS or the like in place of ZnS.

In the embodiment shown in FIG. 1, a second insulation layer 16 has been provided, but said second insulation layer 16 is not absolutely necessary and may be removed. Further, in forming the second insulation layer 16, the second insulation layer 16 need not be in the form of a crystal-orientable ZnO layer. That is, for the second insulation layer 16, such conventional materials as $Y_2O_3$, $Si_3N_4$ and $Al_2O_3$ may be used.

A method of producing the embodiment shown in FIG. 1 will now be described.

Figure 6:
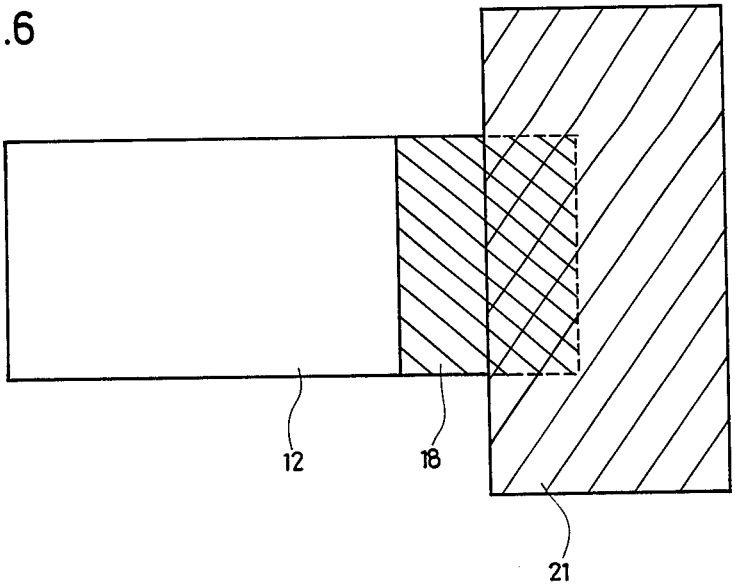
FIG. 6 is a plan view of a light-permeable substrate formed with a lead electrode, showing the substrate masked in preparation for the formation of a thin film in producing the embodiment shown in FIG. 1.

First, the light-permeable substrate 12 of glass is prepared, having the lead electrode 18 formed on the upper surface thereof by vapor-deposition of Al. Then, said light-permeable substrate 12 is set in a substrate holder (not shown) with part of the lead electrode 18 masked. This setting is shown in a plan view in FIG. 6. In FIG. 6, the numeral 21 denotes a mask. Then, the vacuum chamber is evacuated to a pressure of not more than $2\times10^{-6}$ Torr, whereupon the individual layers are formed on the light-permeable substrate 12 by the multi-target sputtering method in the following process.

(1) Formation of ZnO transparent electrode:

The crystal-orientable ZnO transparent electrode 13 is formed by the sputtering method. As the target, use is made of a mixture of ZnO powder and 2 weight % of $Al_2O_3$ powder. The sputtering conditions are shown in Table 1. The film thickness of the crystal-orientable ZnO transparent electrode obtained is about 8000 Å.

TABLE 1

| Sputtering Conditions | |
|---|---|
| Target | ZnO power-2 weight % $Al_2O_3$ powder |
| Sputtering system | RF magnetron |
| Sputtering power | 50 W |
| Sputtering gas | Ar |
| Gas pressure | $8\times-10^{-3}$ Torr |
| Time | 40 minutes |
| Substrate heating | Not heated |

(2) Formation of crystal-orientable ZnO insulation layer:

In the same vacuum chamber and by use of a ZnO sintered target, a crystal-orientable ZnO insulation layer is formed by RF magnetron sputtering. This crystal-orientable ZnO insulation layer is in the form of ZnO doped with Li and is formed under the sputtering conditions shown in Table 2. The film thickness is about 2000 Å.

TABLE 2

| Sputtering Conditions | |
|---|---|
| Target | ZnO sintered target doped with Li |
| Sputtering system | RE magnetron |
| Power | 300 W |
| Gas | $Ar/O_2 = 90/10$ |
| Gas pressure | $5\times10^{-3}$ Torr |
| Time | 10 minutes |
| Substrate temperature | 120° C. |

(3) Formation of light emitting layer:

A $ZnS:TbF_3$ light emitting layer is formed by sputtering. The target is prepared by adding 4 weight % $TbF_3$ powder of 99.999% purity to ZnS powder of 99.99% purity and then charging the mixture into a stainless steel dish. The sputtering conditions therefor are shown in Table 3. The film thickness of the light emitting layer is about 5000 Å. After the light emitting layer has been formed, it is heat treated in a vacuum at 450° C. for 1 hour.

TABLE 3

| Sputtering Conditions | |
|---|---|
| Target | ZnS powder-4 weight % $TbF_3$ |
| Sputtering system | RF magnetron |
| Power | 60 W |
| Gas | Ar |
| Gas pressure | $5\times10^{-3}$ Torr |
| Time | 40 minutes |
| Substrate temperature | 150° C. |

(4) Formation of second insulation layer:

A vapor-deposited film of $Y_2O_3$ is formed on the light emitting layer by electron beam vapor-deposition. The thickness of the vapor-deposited film of $Y_2O_3$ is approximately 2000 Å.

The structure obtained in the manner described above is formed with a back electron beam vapor-deposition of Al, thereby forming the AC-driven type thin film EL element of the embodiment shown in FIG. 1.

Figure 7:
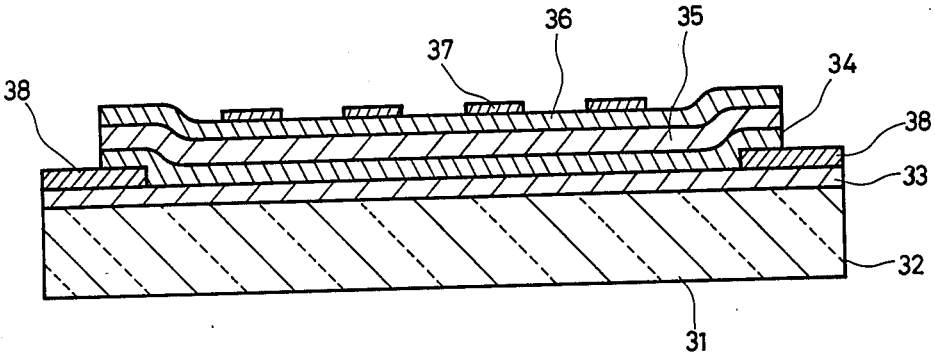
FIG. 7 is a sectional view of a thin film EL element according to a second embodiment of the invention.

FIG. 7 is a sectional view showing a thin film EL element according to another embodiment of the invention. In FIG. 7, the thin film EL element 31 has a transparent electrode 33 formed on a light-permeable substrate 32 made, e.g., of Corning's 7059 glass. The transparent electrode 33 is made, e.g., of $In_2O_3$—$SnO_2$ oxide alloy. The opposite ends of th upper surface of the transparent electrode 33 have lead electrodes 38 of Al formed thereon by vapor-deposition. Other portions of the upper surface of the transparent electrode 33 have formed thereon a first insulation layer 34, which is transparent and which has crystal-orientability. The first insulation layer 34 is in the form, e.g., of a crystalline film of zinc oxide with its c-axis extending perpendicular to the transparent substrate 32. This crystalline film of zinc oxide contains 1-2 mol % Li and is formed by a method such as RF magnetron sputtering. A light emitting layer 35 of $ZnS:TbF_3$ is formed by sputtering on the upper surface of the first insulation layer 34, the upper surface of said light emitting layer having formed thereon a second insulation layer 36 and an electrode 37.

In the thin film EL element 31 of this construction, since the first insulation layer 34 has high c-axis orientability, a ZnS film of superior crystallinity will grow when the light emitting layer 35 is formed; thus, high brightness, high efficiency and low voltage drive can be attained.

As for the light emitting layer 35, in the above example $ZnS:TbF_3$ was used, but other types of light emitting layers may also be used that include any other desired types of ZnS, such as ZnS:Mn, $ZnS:PrF_3$, $ZnS:DyF_3$, $ZnS:TmF_3$ and ZnS:Cu. It is also possible to use other types of light emitting layers made mainly of SrS, CaS and ZnSe in place of ZnS.

Further, in the embodiment shown in FIG. 7, a second insulation layer 36 has been formed, but this second insulation layer 36 is not absolutely necessary and may be removed. Further, though not shown, a third insulation layer may be formed between the transparent electrode 33 and the first insulation layer 34. In that case, reliability of protection against insulation breakdown can be increased. As for the second insulation layer 36 and the third insulation layer (not shown), they may be made of conventional materials, such as $Y_2O_3$, $Si_3N_4$, $Al_2O_3$, and the like. As for the third insulation layer, it should be made of a material having light-permeability.

The method of producing the thin film EL element shown in FIG. 7 will now be described.

First, the light-permeable substrate 32 of glass is prepared. Then, the individual layers are formed on the light-permeable substrate 32 by the following process.

(1) Formation of transparent electrode:

The transparent electrode is made of $In_2O_3$—$SnO_2$ oxide alloy by chemical vapor-deposition. The thickness of the $In_2O_3$—$SnO_2$ alloy film obtained is about 2000 Å.

(2) Formation of lead electrode:

A mask (not shown) is placed on the transparent electrode, with portions of the transparent electrode, specifically its opposite ends, exposed, and the lead electrode of Al is formed by vacuum vapor-deposition.

(3) Formation of the first insulation layer:

The light-permeable substrate formed with the transparent electrode is placed in a vacuum chamber, and a zinc oxide sintered target is used to form a crystalline film of zinc oxide which is transparent and crystal-orientable. This first insulation layer of crystal-orientable zinc oxide is made of ZnO having 1-2 mol % Li added thereto and is formed under the conditions shown in Table 4. The film thickness is about 2500 Å.

TABLE 4

| | |
|---|---|
| Target | Sintered ceramics of zinc oxide containing li |
| Sputtering system | RF magnetron sputtering |
| Power | 300 W |
| Gas | $Ar/O_2 = 90/10$ |
| Gas pressure | $5 \times 10^{-3}$ Torr |
| Time | 10 minutes |
| Substrate temperature | 120° C. |

(4) Formation of light emitting layer:

A light emitting layer of $ZnS:TbF_3$ is formed by sputtering. As for the target, 4 weight % $TbF_3$ powder of 99.999% purity is added to ZnS powder of 99.99% purity and this mixture is sufficiently dehydrated in an Ar atmosphere at 500° C. and charged into a stainless steel dish. The sputtering conditions are shown in Table 5. As for the film thickness of the light emitting layer, two examples having different thicknesses are produced: about 850 Å and about 6500 Å. After being formed, the light emitting layer is heat treated in a vacuum at 450° C. for 1 hour.

TABLE 5

| | |
|---|---|
| Target | ZnS powder-4 weight % $TbF_3$ |
| Sputtering system | RF magnetron sputtering |
| Power | 80 W |
| Gas | Ar |
| Gas pressure | $5 \times 10^{-3}$ Torr |
| Substrate temperature | 180° C. |

(5) Formation of the second insulation layer:

A vapor-deposited film of $Y_2O_3$ is formed as the second insulation layer on the light emitting layer by electron beam vapor-deposition. The film thickness of the bapor-deposited film of $Y_2O_3$ is about 2000 Å.

The structure obtained in the manner described above is formed with an electrode of Al by vapor-deposition, whereby the thin film EL element shown in FIG. 7 is obtained.

After the light emitting layer has been formed, each of the two thin film EL elements having different light emitting layer thicknesses is subjected to X-ray diffraction analysis of the light emitting layer of $ZnS:TbF_3$.

Figure 8:
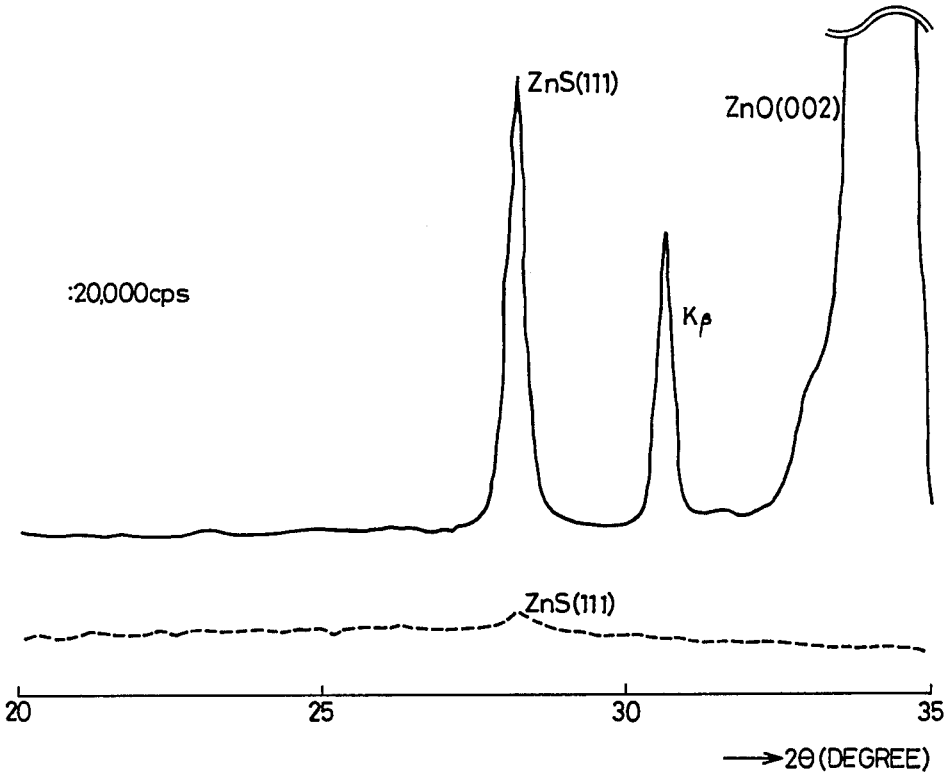
FIG. 8 is a graph showing an X-ray diffraction pattern wherein the film thickness of a light emitting layer of $ZnS:TbF_3$ is about 850 Å.
Figure 9:
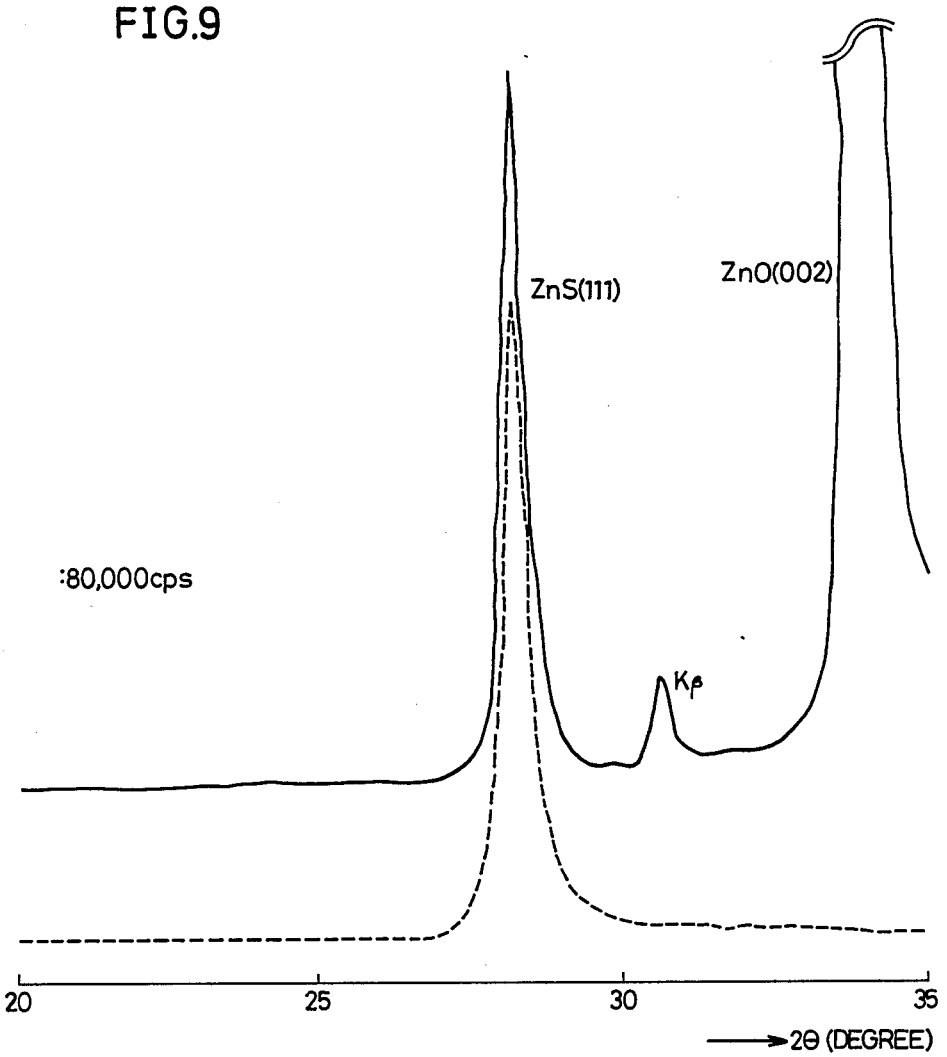
FIG. 9 is a graph showing an X-ray diffraction pattern wherein the film thickness of a light emitting layer of $ZnS:TbF_3$ is about 6500 Å.

FIG. 8 shows an X-ray diffraction pattern of the element wherein the light emitting layer of $ZnS:TbF_3$ has a film thickness of about 850 Å. FIG. 9 shows an X-ray diffraction pattern of the element wherein the light emitting layer of $ZnS:TbF_3$ has a film thickness of about 6500 Å. The X-ray diffraction pattern is shown in solid line.

In addition, as comparative examples, the first insulation layer is formed in a thickness of about 2000 Å using $Al_2O_3$, and light emitting layers of about 850 Å and about 6500 Å are then formed, as in the above embodiment, on the first insulation layer, and X-ray diffraction analysis is conducted. The individual X-ray diffraction patterns are shown in broken lines in FIGS. 8 and 9.

The first insulation layer of $Al_2O_3$ in the comparative examples is formed by sputtering. The sputtering conditions are shown in Table 6.

TABLE 6

| | |
|---|---|
| Target | $Al_2O_3$ sintered ceramics |
| Sputtering system | RF magnetron sputtering |
| Power | 100 W |
| Gas | $Ar/O_2 = 90/10$ |
| Time | 60 minutes |
| Substrate temperature | 200° C. |

In FIG. 9, it can be understood that even if the material of the first insulation layer differs, there is not much difference in the X-ray diffraction intensity of the light emitting layer of $ZnS:TbF_3$, as long as the light emitting layer is thick to a certain extent, i.e., about 6500 Å. However, as can be seen in FIG. 8, in the case where the first insulation layer is formed of a crystalline film of zinc oxide having crystalline orientability, (111) of ZnS of improved crystalline orientability grows on the first insulation layer even if the film thickness of the light emitting layer is about 850 Å. On the other hand, in the conventional structure where the first insulation layer of $Al_2O_3$ is the sublayer, it can be understood that the light emitting layer of ZnS is in the amorphous state, so that improved crystalline orientability is not attained and there is a difficulty in obtaining crystallinity in early periods of growth.

In the embodiments shown in FIGS. 1 and 7, the substrates 12 and 32 and the electrodes 13 and 33 are made of a material having light permeability, so that images produced by the emission of light from the light emitting layer can be viewed from the side of the substrates 12 and 32. However, a thin film EL element can be arranged by using electrodes 17 and 37 and insulating layers made of a material having light permeability, so that images are viewed from the opposite side, i.e., from the side of the electrodes 17 and 37, in which case the substrates 12 and 32 and the electrodes 13 and 33 need not be light-permeable. Thus, it is seen that in this invention "light permeability" is not an essential condition for the substrate.

As described above, in producing the thin film EL elements 11 and 31 shown in FIGS. 1 and 7, the transparent electrodes 13, 33, the crystal-orientable ZnO insulation layers 14, 34 (that is, the first insulation layers), and the light emitting surfaces 15, 35 can be formed in one and the same vacuum chamber. Therefore, the interface between adjacent layers is kept clean and since evacuation need be done only once, operating time can be reduced and hence the present method is superior in operating efficiency and mass production.

In addition, in the case where the second insulation layers 16 and 36 are to be made of $Al_2O_3$ or $Si_3N_4$ instead of $Y_2O_3$ by a sputtering method, sintered ceramics of these materials can be provided as targets in the same vacuum chamber. Therefore, in this case, all the individual layers can be formed in the same vacuum chamber. To form the transparent electrode in a matrix pattern, first, a crystal-orientable ZnO insulation layer is formed as a sublayer on the light-permeable substrate and then a ZnO transparent electrode is formed thereon. In this state, it is etched to provide a ZnO transparent electrode in a matrix pattern. A crystal-orientable ZnO insulation layer is then formed thereon. By forming the crystal-orientable ZnO insulation layer of suitable thickness as a sublayer in this manner, a ZnO transparent electrode and ZnO insulation layer having improved crystalline orientability can be formed thereon even if the film thickness of the ZnO transparent electrode and ZnO insulation layer is small. In this manner, a possible decrease in voltage breakdown strength which would occur in the edge portion if the ZnO transparent electrode were thick can be avoided.

Figure 10:
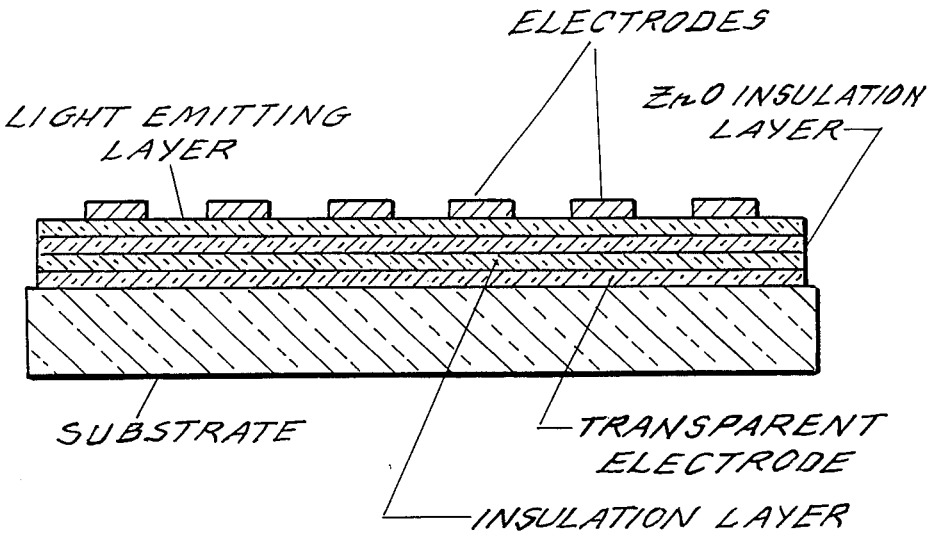
FIG. 10 is a sectional view of a thin-film EL element according to a third embodiment of the invention.

FIG. 10 shows a third embodiment of the invention, comprising a substrate, a transparent electrode formed on the substrate, a ZnO insulation layer formed on the transparent electrode which ZnO insulation layer is transparent and has crystalline orientability, a light emitting layer formed on the ZnO insulation layer, a second electrode formed on the light emitting layer, and an insulating layer formed between the transparent electrode and the ZnO insulation layer.

Figure 11:
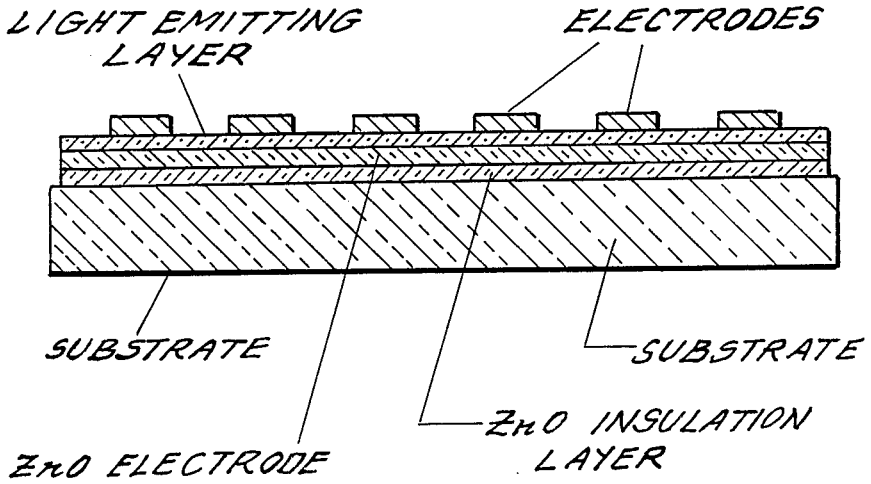
FIG. 11 is a sectional view of a thin-film EL element according to a fourth embodiment of the invention.

FIG. 11 shows a fourth embodiment, comprising a substrate, a crystal-orientable ZnO electrode formed on the substrate, a light emitting layer formed on the ZnO electrode, a second electrode formed on the light emitting layer, and a crystal-orientable ZnO insulation layer formed between the substrate and the crystal-orientable ZnO electrode.

Although embodiments of the present invention have been described and illustrated in detail, it is clearly understood that the same is by way of illustration and example only and is not to be taken by way of limitation, the spirit and scope of the present invention being limited only by the terms of the appended claims.

What is claimed is:

1. A thin film EL element comprising:
a substrate,
a transparent electrode,
a light emitting layer, and
as a sublayer for said light emitting layer, a crystal-orientable ZnO layer with its c-axis oriented perpendicular to the substrate, said light emitting layer being formed on said ZnO layer with a crystallinity corresponding to that of said ZnO layer.

2. A thin film EL element as set forth in claim 1, wherein said crystal-orientable ZnO layer is insulative.

3. A thin film EL element as set forth in claim 1 wherein said crystal-orientable ZnO layer is electrically conductive.

4. A thin film EL element as set forth in claim 1, wherein said crystal-orientable ZnO layer is electrically conductive, at least part of said ZnO layer forming said transparent electrode.

5. A thin film EL element as set forth in claim 1, wherein said substrate is a light-permeable substrate.

6. A thin film EL element comprising:
a substrate,
a transparent electrode formed on said substrate,
a ZnO insulation layer formed on said transparent electrode which ZnO insulation layer is transparent and has crystalline orientability,
a light emitting layer formed on said ZnO insulation layer with crystallinity corresponding to that of said ZnO insulation layer, and
a second electrode formed on said light emitting layer.

7. A thin film EL element as set forth in claim 6, wherein an insulation layer is formed between said light emitting layer and said second electrode.

8. A thin film EL element as set forth in claim 6, wherein said substrate is a light-permeable substrate.

9. A thin film EL element comprising:
a substrate,
a crystal-orientable ZnO electrode formed on said substrate,
a light emitting layer formed on said ZnO electrode with crystallinity corresponding to that of said ZnO electrode, and
a second electrode formed on said light emitting layer.

10. A thin film EL element comprising:
a substrate,
a transparent electrode formed on said substrate,
a ZnO insulation layer formed on said transparent electrode which ZnO insulation layer is transparent and has crystalline orientability,
a light emitting layer formed on said ZnO insulation layer,
a second electrode formed on said light emitting layer; and
an insulating layer formed between said transparent electrode and said ZnO insulation layer.

11. A thin film EL element comprising:
a substrate;
a crystal-orientable ZnO electrode formed on said substrate,
a light emitting layer formed on said ZnO electrode,
a second electrode formed on said light emitting layer; and
a crystal orientable ZnO insulation layer formed between said crystal-orientable ZnO electrode and said light emitting layer.

12. A thin film EL element as set forth in claim 11, wherein said crystal-orientable ZnO insulation layer is made of ZnO doped with Li.

13. A thin film EL element as set forth in claim 11, wherein said crystal-orientable ZnO electrode is made of ZnO doped with Al.

14. A thin EL element comprising:
a substrate;
a crystal-orientable ZnO electrode formed on said substrate,
a light emitting layer formed on said ZnO electrode,
a second electrode formed on said light emitting layer; and
a crystal-orientable ZnO insulation layer formed between said substrate and said crystal-orientable ZnO electrode.

15. A thin film EL element comprising:
a substrate;
a crystal-orientable ZnO electrode formed on said substrate, wherein said crystal-orientable ZnO electrode is made of ZnO doped with a modifying agent,
a light emitting layer formed on said ZnO electrode, and
a second electrode formed on said light emitting layer.

16. A thin film EL element as set forth in claim 15 wherein said modifying agent is one or more of the elements selected from the class consisting of Li and Al.

17. A thin film EL element comprising:
a substrate,
a transparent electrode,
a light emitting layer, and
as a sublayer for said light emitting layer, a crystal-orientable ZnO layer with its c-axis oriented perpendicular to the substrate;
wherein said ZnO layer is insulative and is made of ZnO doped with Li.

18. A thin film EL element comprising:

a substrate, a transparent electrode formed on said substrate, a ZnO insulation layer formed on said transparent electrode which ZnO insulation layer is transparent and has crystalline orientability, wherein said crystal-orientable ZnO insulation layer is made of ZnO doped with Li, a light emitting layer formed on said ZnO insulation layer, and a second electrode formed on said light emitting layer.

19. A thin film EL element comprising:

a substrate, a transparent electrode, a light emitting layer, and as a sublayer for said light emitting layer, a crystal-orientable ZnO layer with its c-axis oriented perpendicular to the substrate;

wherein said ZnO layer is electrically conductive and is made of ZnO doped with Al.

20. A thin film EL element comprising:

a substrate;

a crystal-orientable ZnO electrode formed on said substrate, wherein said crystal-orientable ZnO electrode is made of ZnO doped with Al, a light emitting layer formed on said ZnO electrode, and a second electrode formed on said light emitting layer.

* * * * *